US009396856B2

(12) United States Patent
Goldie et al.

(10) Patent No.: US 9,396,856 B2
(45) Date of Patent: Jul. 19, 2016

(54) MAGNET APPARATUS

(71) Applicant: Tesla Engineering Limited, West Sussex (GB)

(72) Inventors: Frederick Thomas David Goldie, West Sussex (GB); Patrick Brian Clayton, West Sussex (GB)

( * ) Notice: Subject to any disclaimer, the term of this patent is extended or adjusted under 35 U.S.C. 154(b) by 0 days.

(21) Appl. No.: 14/673,505

(22) Filed: Mar. 30, 2015

(65) Prior Publication Data

US 2015/0206636 A1 Jul. 23, 2015

Related U.S. Application Data

(62) Division of application No. 14/046,352, filed on Oct. 4, 2013, now Pat. No. 9,019,054.

(30) Foreign Application Priority Data

Oct. 4, 2012 (GB) ..... 1217782.0

(51) Int. Cl.

| | |
|---|---|
| ***H01F 1/00*** | (2006.01) |
| ***H01F 6/06*** | (2006.01) |
| ***H01F 6/04*** | (2006.01) |
| ***H01F 6/00*** | (2006.01) |

(52) U.S. Cl.

CPC .. *H01F 6/06* (2013.01); *H01F 6/00* (2013.01); *H01F 6/04* (2013.01)

(58) Field of Classification Search

CPC ... H01H 33/18; H01H 33/187; H01H 33/664; H01H 33/982; G01R 33/44; G01R 33/48; G01R 33/38

USPC ..... 335/216

See application file for complete search history.

(56) References Cited

U.S. PATENT DOCUMENTS

| | | | | | |
|---|---|---|---|---|---|
| 4,526,500 | A | * | 7/1985 | Patrick | B60P 7/16 410/47 |
| 4,829,252 | A | * | 5/1989 | Kaufman | G01R 33/3806 324/309 |
| 4,924,198 | A | * | 5/1990 | Laskaris | G01R 33/3815 174/15.4 |
| 5,210,512 | A | * | 5/1993 | Davies | G01R 33/3815 335/216 |
| 5,222,366 | A | | 6/1993 | Herd et al. | |
| 5,291,169 | A | * | 3/1994 | Ige | G01R 33/3875 324/319 |
| 5,363,077 | A | | 11/1994 | Herd et al. | |
| 5,381,122 | A | * | 1/1995 | Laskaris | G01R 33/3806 324/318 |

(Continued)

FOREIGN PATENT DOCUMENTS

| | | |
|---|---|---|
| EP | 0797059 A2 | 9/1997 |
| EP | 1314393 A1 | 5/2003 |

(Continued)

*Primary Examiner* — Shawki S Ismail
*Assistant Examiner* — Lisa Homza
(74) *Attorney, Agent, or Firm* — Jeffrey K. Riddle; Fabian VanCott

(57) ABSTRACT

A magnet apparatus which comprises a first vacuum chamber, a second vacuum chamber, a first magnet disposed within the first vacuum chamber such that the first magnet can be thermally isolated from the exterior of the first vacuum chamber, and a load connector extending from the first vacuum chamber into the second vacuum chamber so that a load on the first magnet can be transferred to the second vacuum chamber, wherein the load connector is in thermal contact with the first magnet and can be thermally isolated from the exterior of the first vacuum chamber and the exterior of the second vacuum chamber.

13 Claims, 11 Drawing Sheets

(56) References Cited

U.S. PATENT DOCUMENTS 5,410,287 A * 4/1995 Laskaris ..... G01R 33/3806 324/318
5,430,423 A 7/1995 Herd et al.
5,563,566 A * 10/1996 Laskaris ..... G01R 33/3806 324/318
5,565,831 A * 10/1996 Dorri ..... G01R 33/3806 324/318
6,172,588 B1 * 1/2001 Laskaris ..... G01R 33/3815 335/296
6,289,681 B1 * 9/2001 Eckels ..... F17C 3/085 335/216
6,570,475 B1 * 5/2003 Lvovsky ..... G01R 33/421 324/319
7,276,908 B2 * 10/2007 Suzuki ..... G01R 33/3806 324/318
7,528,605 B2 * 5/2009 Chiba ..... G01R 33/3804 324/318
2002/0087064 A1 * 7/2002 Tsuda ..... G01R 33/3806 600/410
2002/0145426 A1 * 10/2002 Minas ..... G01R 33/3806 324/318
2005/0197564 A1 * 9/2005 Dempsey ..... A61B 5/055 600/411
2006/0290351 A1 * 12/2006 Matsumoto ..... G01R 33/3815 324/318
2007/0108979 A1 * 5/2007 Ryan ..... G01R 33/3815 324/318
2008/0104968 A1 5/2008 Radovinsky et al.
2009/0149735 A1 * 6/2009 Fallone ..... A61N 5/1049 600/411
2009/0299170 A1 * 12/2009 Gebhardt ..... A61B 5/055 600/411
2010/0033186 A1 * 2/2010 Overweg ..... A61B 5/055 324/318
2010/0231215 A1 * 9/2010 Ma ..... G01R 33/3403 324/307
2011/0012593 A1 * 1/2011 Shvartsman ..... G01R 33/421 324/307
2011/0121832 A1 * 5/2011 Shvartsman ..... G01R 33/385 324/318
2011/0241684 A1 * 10/2011 Dempsey ..... A61B 5/055 324/318
2011/0304416 A1 * 12/2011 Warner ..... F17C 13/081 335/216
2013/0023418 A1 * 1/2013 Ackermann ..... F25B 9/10 505/162
2013/0078112 A1 * 3/2013 McIver ..... F03G 7/08 417/48

FOREIGN PATENT DOCUMENTS

EP 1530058 A2 5/2005
GB 2313182 A 11/1997
JP 02237101 A 9/1990
JP 10340811 A 12/1998
JP 04361526 A 12/2012

* cited by examiner

MAGNET APPARATUS

The present application claims the benefit of U.S. patent application Ser. No. 14/046,352, filed Oct. 4, 2013, which claims the benefit under 35, U.S.C. §119(a)-(d) of European Patent Application No. EP 1217782.0, filed Oct. 4, 2012. These applications are herein incorporated by reference in their entirety.

The present invention relates to an arrangement for housing a magnet in a vacuum chamber so that the magnet can be maintained at a low temperature.

High energy physics experiments, medical treatment particle accelerators and other applications require powerful superconducting magnets to form and control beams of high energy particles. Superconducting magnet coils normally operate at low temperatures and are typically housed in a "cold mass" suspended within a vacuum chamber or cryostat to provide a high level of thermal insulation. Cryocoolers are typically used to reduce the temperature of the magnet coils to their operating temperature, typically at approximately 4K. These cryocoolers typically have relatively low power requirements when a single magnet is used in isolation because the vacuum chamber can effectively isolate the cold magnet from its environment.

In some arrangements it is necessary to provide several magnets in close proximity to one another. In these arrangements very high attractive or repulsive mechanical forces can act upon the magnet coils. These forces could potentially damage the suspension system or cause other structural damage unless an appropriate restoring force is provided.

One known method for dealing with these forces is to provide structural support to the magnet within its vacuum chamber. In this way the supporting mechanism can provide a restoring force to resist any movement of the magnet. A disadvantage of this technique is that high strength suspension and support systems usually have relatively poor thermal insulation properties. Thus, the supporting mechanism typically conducts heat from the surrounding environment towards the low temperature magnetic coil. This heating effect means that there is an increased cooling requirement for the magnetic coil, which increases the running costs such that the magnet system may become prohibitively expensive.

Another known method for dealing with these forces is to link magnetic coils together. Typically this is achieved by arranging the relevant magnetic coils in a single vacuum chamber. The link between the magnetic coils can therefore prevent the coils from moving relative to one another. The link can also be maintained at the same low temperature as the magnets so that there is no heat exchange with the surrounding environment. A disadvantage with this approach is that there is limited flexibility in the arrangement of the magnets after construction. If any rearrangement of the magnets was required then the magnets would have to be de-energised and warmed up, and the vacuum chamber would have to be to be opened. The system would then have to be evacuated and cooled back down to its operating temperature before reuse. In addition, the geometry of tensile suspension systems, which are designed to be self-centring during cooling from ambient temperature to operating temperature, is normally optimised for one size of cold mass so this may also have to be adjusted or changed.

The present invention is intended to overcome some of the problems described above.

According to an aspect of the present invention there is provided a magnet apparatus comprising: a first vacuum chamber; a second vacuum chamber; a first magnet disposed within the first vacuum chamber such that the first magnet can be thermally isolated from the exterior of the first vacuum chamber; a load connector attached to the magnet and extending from the first vacuum chamber into the second vacuum chamber so that a load on the first magnet can be transferred to the second vacuum chamber, wherein the load connector is in thermal contact with the first magnet and can be thermally isolated from the exterior of the first vacuum chamber and the exterior of the second vacuum chamber.

Thus, for any load exerted on the magnet, a restoring force can be provided via the load connector. The load connector is in thermal contact with the magnet, which means that it may be at approximately the same temperature. By arranging the load connector in this way it is possible to provide a restoring force from a component that is at the same temperature as the magnet, but is outside the first vacuum chamber.

By providing a load connector that extends from the first vacuum chamber into the second vacuum chamber it is possible for a restoring force to be provided by a component that is outside of the magnet's cryostat. This means that the magnet can be handled separately from the component that provides the restoring force.

Preferably the apparatus comprises a second magnet disposed within the second vacuum chamber and connected to the load connector. In this way, the load connector may be anchored to the second magnet in order to provide a restoring force for the first magnet. In fact, the first and second magnets may exert an equal and opposite force on one another, and restoring forces may be provided via the load connector so that a stable arrangement can be achieved.

The load connector is connected to both the first and second magnets so it is preferably in thermal equilibrium with both of these components. The load connector preferably has a substantially constant temperature along its length which can be achieved because the second vacuum chamber isolates the load connector from its surroundings where it extends out of the first vacuum chamber. In this way a restoring force may be provided to both the first and second magnets without substantially increasing the energy demands for cooling the magnets.

Preferably the apparatus further comprises a third vacuum chamber, disposed between the first vacuum chamber and the second vacuum chamber. In this way the first and second magnets can be fully contained within the first and second vacuum chambers. The third vacuum chamber can be provided in between the magnets to ensure that there are no energy losses due to heating of the load connector where it extends between the first and second vacuum chambers.

The third vacuum chamber may include a port for controlling the air pressure. In some arrangements the third vacuum chamber may be created when the first and second magnets in their respective chambers are brought together. In these circumstances the port can be used to evacuate the chamber once it has been formed so that the load connector can be thermally isolated from its surroundings. Of course, ports for controlling the air pressure may also be provided in the first and second vacuum chambers.

Preferably the first vacuum chamber comprises a first sealing arrangement through which the load connector extends and the second vacuum chamber comprises a second sealing arrangement though which the load connector extends. The third vacuum chamber may be formed between the first and second sealing arrangements. In this way the third vacuum chamber can be created between the first and second sealing arrangements when the two magnets are connected together.

A radiation shield may be arranged between the load connector and an inner wall of the third vacuum chamber in order to shield the load connector from thermal radiation emitted by the inner wall of the third vacuum chamber. In this way the radiation shield can prevent the inner wall of the third vacuum chamber, which may be at room temperature, from increasing the energy requirements for cooling the magnets and the load connector. It is desirable that the radiation shield is maintained at a low temperature so that it does not increase cooling demands by heating the load connector with thermal radiation. In one arrangement the radiation shield may be cooled to approximately 70K. A further radiation shield may be provided between the first magnet and an inner wall of the first vacuum chamber.

The radiation shield in the third vacuum chamber may be thermally coupled to the radiation shield in the first vacuum chamber. In this arrangement the radiation shields can be maintained at the same temperature so that the shielding effect on the first magnet is the same as the shielding effect on the load connector. Of course, the second magnet can be provided with a radiation shield as well.

A thermally insulating coupling may be provided between the load connector and an inner wall of the first vacuum chamber. The load connector is arranged such that it extends from the first vacuum chamber to the second vacuum chamber. Thus, it is important to establish a sealing arrangement around the load connector where it enters/exits a vacuum chamber. In certain configurations it is imperative that the load connector is actually connected to an inner wall of the vacuum chamber in order to create an effective seal. Such a direct connection may create problems as any attempt to cool the load connector would also cool the vacuum chamber. By providing a thermally insulating coupling between the load connector and the inner wall of the vacuum chamber it may be possible to maintain an effective seal around the load connector while minimising heat exchange with the vacuum chamber.

In one arrangement the thermally insulating coupling may be provided by creating a long thermal conduction path between the components. This could be created with a sinuous path such that the coupling resembles compressed bellows.

The thermally insulating coupling may be flexible. In this way the coupling can absorb length changes that occur may occur due to thermal expansion and contraction and/or due to changes in mechanical load or relative movement of the magnets. In this apparatus there may be significant changes in temperature when the magnets are in use in comparison to the idle state. There may also be significant mechanical loads, and significant changes in load. It is therefore desirable that the couplings are flexible enough to deal with changes in temperature or relative movement of the magnets. A flexible arrangement may be provided using a sinuous coupling.

A first thermally insulating coupling may be provided between the load connector and the radiation shield, and a second thermally insulating coupling may be provided between the radiation shield and the inner wall of the first vacuum chamber. In this way the load connector, the radiation shield and the vacuum chambers can be provided at different temperatures as each is thermally insulated from the other. However, all three components can be connected together to ensure that there is an effective seal in the vacuum chamber at the point where the load connector enters/exits a vacuum chamber. In a symmetrical fashion in the second vacuum chamber, a first thermally insulating coupling may be provided between the load connector and the radiation shield, and a second thermally insulating coupling may be provided between the radiation shield and an inner wall of the second vacuum chamber.

The inner wall of the first vacuum chamber may include a flange that is part of the sealing mechanism. Preferably a flexible coupling is provided between the flange of the first vacuum chamber and a corresponding flange of the second vacuum chamber. The load connector may be partially nested within the thermally insulating coupling that connects it to the radiation shield. In this way, the thermally insulating coupling may provide a further shielding effect for the load connector.

In one arrangement the radiation shield is arranged to protect the load connector from thermal radiation emitted from the inner wall of the vacuum chamber. The radiation shield is generally maintained at an intermediate temperature to the load connector and the vacuum chamber. The load connector may be at approximately 4K, the radiation shield may be at approximately 70K and the vacuum chamber may be at approximately 290K (room temperature).

A plurality of load connectors may be attached to the first magnet, and the load connectors may be circumferentially spaced from one another with respect to the main axis of the first magnet. Any load exerted on the first magnet can therefore be distributed among the plurality of load connectors.

The load connector may have a component that extends radially with respect to the main axis of the first magnet. In this way a clear space may be created between the first and second magnets. This may be useful in certain arrangements for performing measurements. In particular, the clear space may be used for performing radiotherapy treatments.

Preferably the first vacuum chamber comprises a mounting that is configured to be assembled to a guide on which the first vacuum chamber can be translated. In one configuration the first vacuum chamber may be mounted on a rail or linear slide. In this way the first magnet can be translated relative to the second magnet so that a selected spacing can be achieved between the two.

The second vacuum chamber may also comprise a mounting that can be assembled to a guide on which the second vacuum chamber can be translated. Preferably the second vacuum chamber can be translated in a different direction to the first vacuum chamber. This can allow flexibility in aligning the load connectors, especially in embodiments where the first and second vacuum chambers can be translated in orthogonal directions.

The load connector may comprise a first portion attached to the first magnet and a second portion attached to the second magnet, and the load connector may further comprise an alignment component to ensure that the first and second portions are correctly aligned. This can allow the first load connector portion to be associated with the first magnet and the second load connector portion to be associated with the second magnet. The first and second magnets can, therefore, be handled separately. When the magnets are brought together the alignment component can ensure that the first and second portions are centred with respect to one another. This configuration can ensure that the load connector distributes the load correctly. The alignment component may comprise a conical projection on the first load connector portion and a corresponding locating piece on the second load connector portion.

The alignment component may permit relative movement of the first and second load connector portions in a selected direction. For example, the alignment component may permit relative movement in a circumferential direction, with respect to the main axis of the magnets, but resist movement in other directions. This could be achieved, for example, with a pinin-slot arrangement. Different types of alignment component may be provided between each pair of load connector portions.

The apparatus may comprise three or more magnets each disposed in a respective vacuum chamber and a load connector may be provided in a vacuum chamber between each pair of adjacent magnets. Thus, the load connectors may provide a restoring force between each pair of magnets in a linear array.

A cap may be provided for the load connector. In this arrangement the first vacuum chamber may comprise a sealing arrangement through which the load connector extends, and the second vacuum chamber may be provided between the cap and the sealing arrangement.

The cap can therefore be used to cover the load connector when it is not connected to a component that can provide a restoring force. The second vacuum chamber created between the cap and the sealing arrangement can ensure that the load connector remains thermally isolated from its surroundings, even when the first magnet is used on its own.

The load connector may comprise an end face and the first sealing arrangement preferably comprises a biasing member for biasing a component of the first sealing arrangement away from the end face. This arrangement preferably minimises any thermal contact between the sealing arrangement and the load connector.

According to a second aspect of the invention there is provided a magnet apparatus comprising: a first vacuum chamber; a second vacuum chamber; a first magnet disposed within the first vacuum chamber such that the first magnet can be thermally isolated from the exterior of the first vacuum chamber; a second magnet disposed within the second vacuum chamber such that the second magnet can be thermally isolated from the exterior of the second vacuum chamber; a load connector attached to the first magnet and the second magnet and extending from the first vacuum chamber into the second vacuum chamber so that a load on the first magnet can be transferred to the second magnet, wherein the load connector is in thermal contact with the first and second magnets and can be thermally isolated from the exterior of the first and second vacuum chambers.

According to a third aspect of the present invention there is provided a magnet apparatus comprising: a first vacuum chamber; a second vacuum chamber; a first magnet disposed within the first vacuum chamber such that the first magnet can be thermally isolated from the exterior of the first vacuum chamber; a load connector extending from the first vacuum chamber into the second vacuum chamber so that a load on the first magnet can be transferred to the second vacuum chamber, wherein the load connector is in thermal contact with the first magnet and can be thermally isolated from the exterior of the first vacuum chamber and the exterior of the second vacuum chamber.

According to a fourth aspect of the present invention there is provided a magnet apparatus comprising: a first vacuum chamber; a second vacuum chamber; a first magnet disposed within the first vacuum chamber such that the first magnet can be thermally isolated from the exterior of the first vacuum chamber; a load connector extending from the first vacuum chamber into the second vacuum chamber and being mechanically contactable with the first magnet so that a load on the first magnet can be transferred to the second vacuum chamber, wherein the load connector is in thermal contact with the first magnet and can be thermally isolated from the exterior of the first vacuum chamber and the exterior of the second vacuum chamber.

According to a fifth aspect of the present invention there is provided a magnet apparatus comprising: a first vacuum chamber; a second vacuum chamber; a first magnet disposed within the first vacuum chamber such that the first magnet can be thermally isolated from the exterior of the first vacuum chamber; a load connector extending from the first vacuum chamber into the second vacuum chamber and being attached to the first magnet or mechanically contactable with the first magnet so that a load on the first magnet can be transferred to the second vacuum chamber, wherein the load connector is in thermal contact with the first magnet and can be thermally isolated from the exterior of the first vacuum chamber and the exterior of the second vacuum chamber.

According to a sixth aspect of the invention there is provided a magnet apparatus comprising: a first vacuum chamber; a second vacuum chamber; a first magnet disposed within the first vacuum chamber such that the first magnet can be thermally isolated from the exterior of the first vacuum chamber; a second magnet disposed within the second vacuum chamber such that the second magnet can be thermally isolated from the exterior of the second vacuum chamber; a load connector extending from the first vacuum chamber into the second vacuum chamber so that a load on the first magnet can be transferred to the second magnet, wherein, in use, the load connector is in thermal contact with the first and second magnets and can be thermally isolated from the exterior of the first and second vacuum chambers.

According to a seventh aspect of the invention there is provided a magnet apparatus comprising: a first vacuum chamber; a second vacuum chamber; a first magnet disposed within the first vacuum chamber such that the first magnet can be thermally isolated from the exterior of the first vacuum chamber; a second magnet disposed within the second vacuum chamber such that the second magnet can be thermally isolated from the exterior of the second vacuum chamber; a load connector extending from the first vacuum chamber into the second vacuum chamber and being mechanically contactable with the first magnet and the second magnet so that a load on the first magnet can be transferred to the second magnet, wherein, in use, the load connector is in thermal contact with the first and second magnets and can be thermally isolated from the exterior of the first and second vacuum chambers.

According to an eight aspect of the invention there is provided a magnet apparatus comprising: a first vacuum chamber; a second vacuum chamber; a first magnet disposed within the first vacuum chamber such that the first magnet can be thermally isolated from the exterior of the first vacuum chamber; a second magnet disposed within the second vacuum chamber such that the second magnet can be thermally isolated from the exterior of the second vacuum chamber; a load connector extending from the first vacuum chamber into the second vacuum chamber and being one of mechanically contactable with and attached to the first magnet and the second magnet, so that a load on the first magnet can be transferred to the second magnet, wherein, in use, the load connector is in thermal contact with the first and second magnets and can be thermally isolated from the exterior of the first and second vacuum chambers.

The load connector may be mechanically contactable with the first and/or second magnet without being attached thereto. The apparatus may be arranged so that the load connector only mechanically contacts the or each magnet in use, for example only when the or each magnet is energised.

Thus in some embodiments the load connector may be attached to one or more of the magnets but in other embodiments the load connector may be unattached to, but in contact with or contactable with one or both of the magnets.

Therefore above when there is mention of the load connector being attached to a magnet it should be recognised that in alternatives there may be the corresponding feature but contact or contactability rather than attachment. This can help to allow lateral movement between parts of the apparatus.

The load connector will typically be a multipart entity. Thus for example, the load connector may comprise a load connector pin and at least one separate sealing plate. The sealing plate may be part of a sealing arrangement. The load connector pin may be housed within at least one sealing arrangement.

The important function of the load connector is to transfer load when the or each magnet is energised. Provided that this can be achieved the number of separate components that go together to make up the load connector is at least in some circumstances not particularly relevant.

Similarly the load connector may only be in thermal contact with one or both of the magnets when in use.

The load connector may be retro-fittable. In such a case it is more likely that the load connector will not be attached to the magnet.

The load connector may comprise part of at least one sealing arrangement. The at least one sealing arrangement may comprise the load connector. The sealing arrangement may comprise a pair of sealing arrangement portions.

The load connector pin may be received in a first socket provided in a first sealing arrangement portion which is for sealing the first vacuum chamber and received in a second socket provided in a second sealing arrangement portion which is for sealing the second vacuum chamber.

Each of the features described above after each of the above aspects of the invention are equally applicable to each of the respective other aspects of the invention. These features are not re-written after each aspect of the invention in the interests of brevity.

Preferred features of the present invention will now be described, purely by way of example, with reference to the accompanying drawings, in which.

Figure 1:
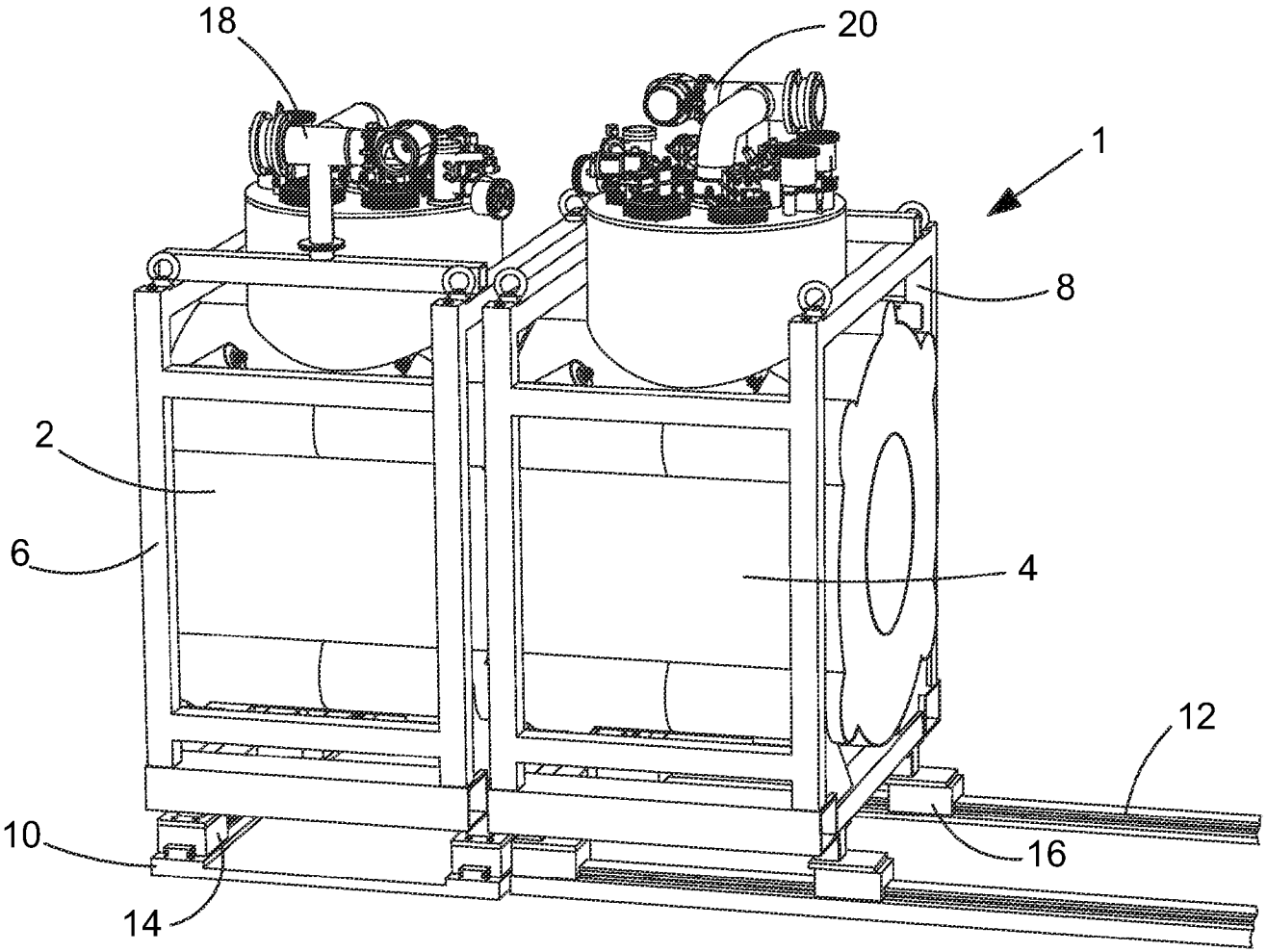
FIG. 1 is a perspective view of an apparatus including two superconducting magnets in an embodiment of the present invention.
Figure 2:
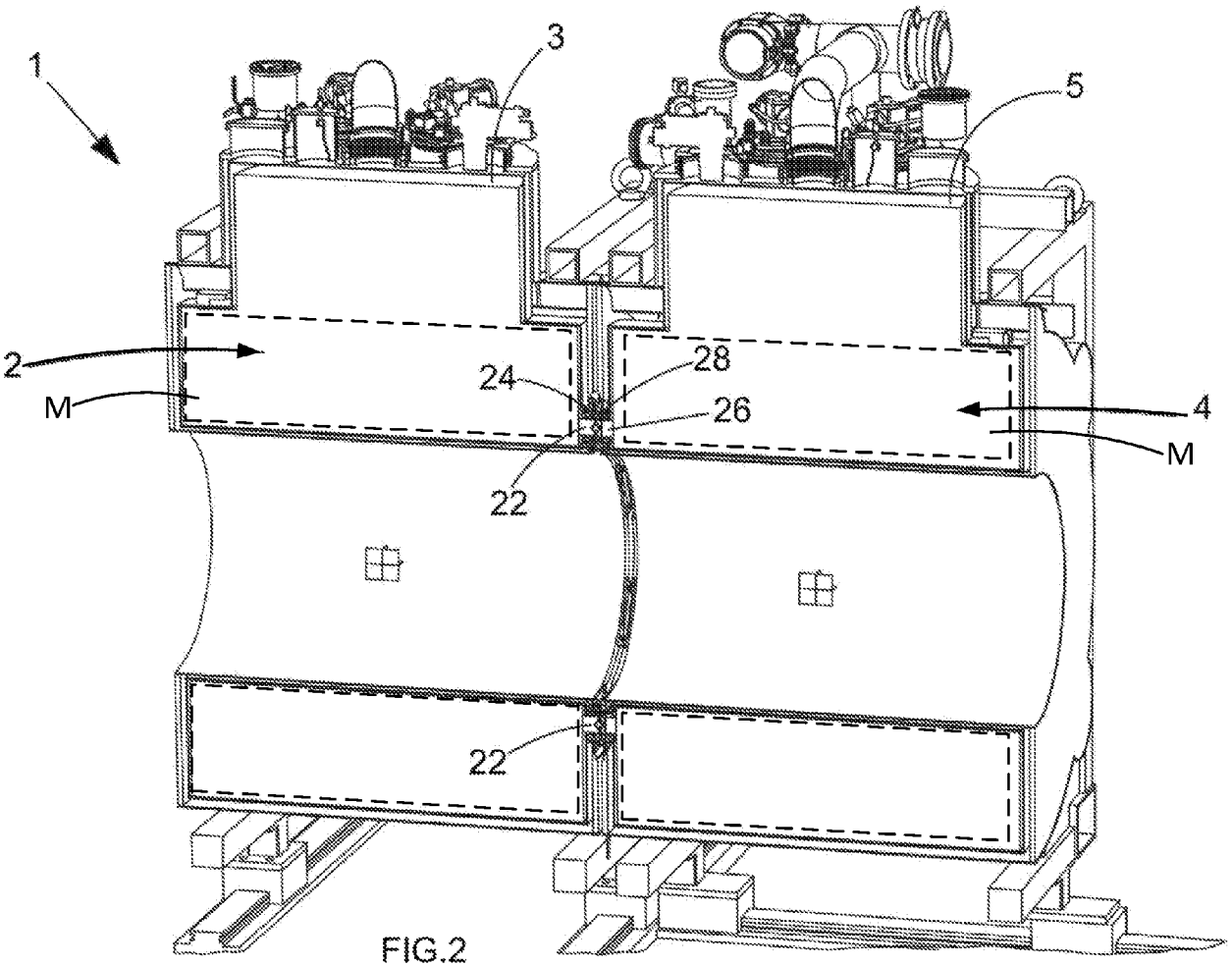
FIG. 2 is a cross-sectional view of the apparatus shown in FIG. 1.

FIGS. 1 and 2 show an apparatus 1 comprising a first vacuum chamber 2 and a second vacuum chamber 4. Superconducting magnets (M) are disposed in the respective vacuum chambers 2, 4. A cooling assembly 18 is provided in the first vacuum chamber 2 for cooling the magnet to approximately 4K. A corresponding cooling assembly 20 is provided in the second vacuum chamber 4. The cooled magnets are suspended in the vacuum chambers 2, 4 so that they can be maintained at a low temperature with minimal conductive or convective heating from the surroundings.

A radiation shield 3, 5 is provided in each vacuum chamber. The radiation shield 3, 5 is arranged between the cooled magnet and an inner wall of the relevant vacuum chamber 2, 4. The radiation shield 3, 5 can intercept thermal radiation emitted by the inner wall of the vacuum chamber to prevent it from heating the magnet. The radiation shield 3, 5 is arranged at a low temperature of around 70K so that it does not cause a significant heating effect for the magnet due to thermal radiation.

Each vacuum chamber 2, 4 is supported by a frame 6, 8, and each frame is mounted on a rail system 10, 12 using guide blocks 14, 16. In this way the frames 6, 8 are designed to slide on the rails 10, 12 independently of each other. The rails 10, 12 are arranged orthogonally so that the vacuum chambers 2, 4 can be translated in orthogonal directions. Specifically, the first vacuum chamber 2 can be translated in a direction that is tangential to the main axis of its magnet and the second vacuum chamber 4 can be translated in a direction that is parallel to the main axis of its magnet. This arrangement allows the magnets to be aligned correctly and means that the separation of the magnets can be carefully controlled.

The magnet in the first vacuum chamber 2 is connected to a plurality of load connectors 22. The load connectors 22 are spaced circumferentially with respect to one another and extend in an axial direction with respect to the main axis of the magnet. A sealing mechanism 24 is arranged around each load connector 22 to define the boundary of the first vacuum chamber 2. In a symmetrical fashion, the magnet in the second vacuum chamber 4 is connected to a plurality of load connectors 26, each of which has an associated sealing mechanism 28.

The load connectors 22 connected to the first magnet are arranged to abut the load connectors 26 that are connected to the second magnet. In this way the load connectors 22, 26 can provide a restoring force to counter an attractive or repulsive force between the magnets. This configuration can ensure that there is minimal relative movement of the magnets within their respective vacuum chambers.

Figure 3:
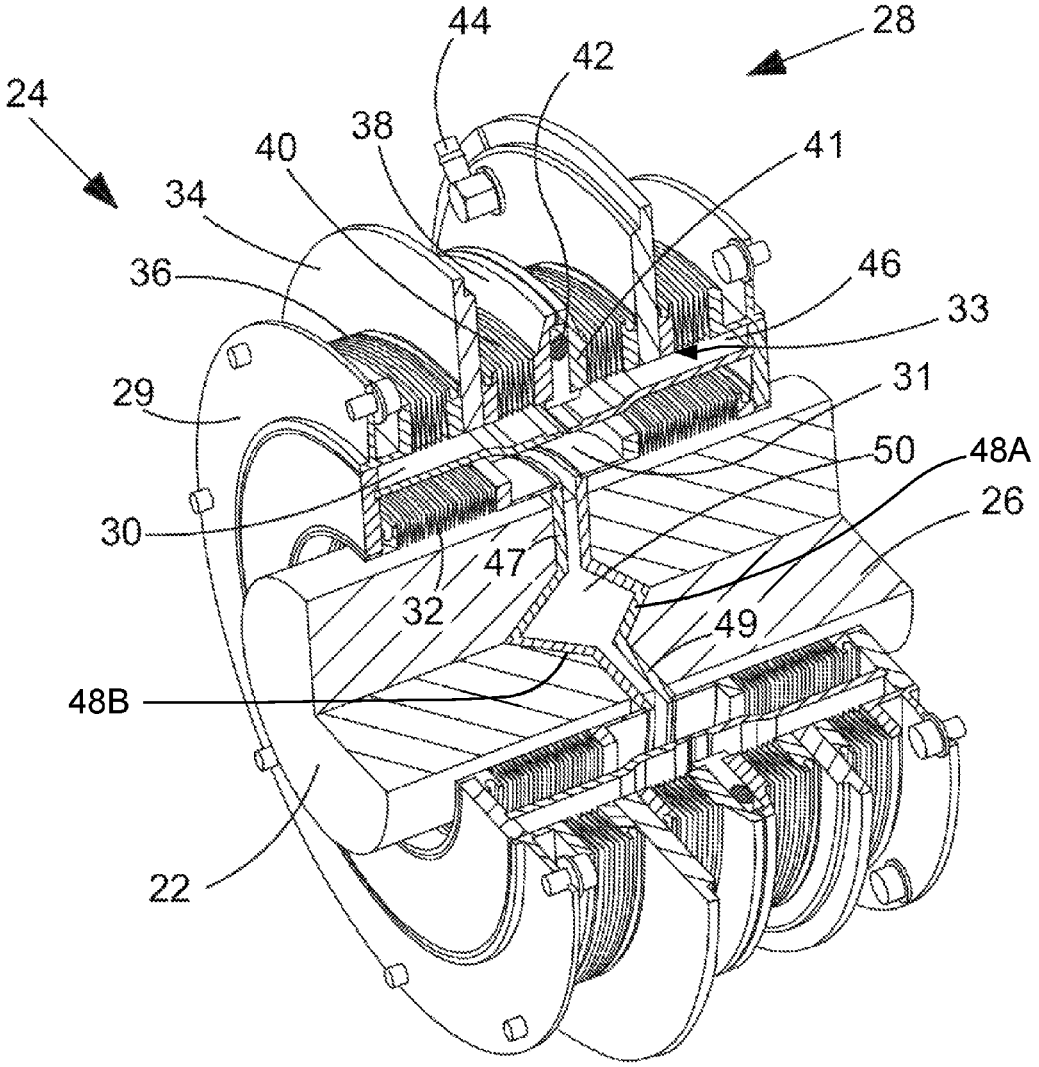
FIG. 3 is a view in partial cross-section of a sealing mechanism for use in an apparatus in an embodiment of the invention.

The sealing mechanisms 24, 28 associated with the respective vacuum chambers 2, 4 are symmetric, and further details are apparent from FIG. 3. The first load connector 22 is connected to a sealing plate 47 which extends across an end face of the load connector. The sealing plate 47 defines a boundary of the first vacuum chamber 2 and it is in thermal equilibrium with the load connector 22 and the first magnet, at approximately 4K. The sealing plate 47 is connected to a radiation shield 30 by metallic bellows 32, which are convoluted edge welded and act as a thermal insulator. The metallic bellows 32 extend from the end face of the load connector 22 back towards the first vacuum chamber 2 so that the load connector 22 is partially nested within the bellows 32. The radiation shield 30 is connected to a flange 29 that is riveted to the radiation shield 3 in the first vacuum chamber 2. The flange 29 is connected to a further flange 34 by metallic bellows 36. The flange 34 is welded to an outer part of the first vacuum chamber 2 and is at a temperature of around 290K.

The radiation shield 30 extends from the flange 29 towards the second vacuum chamber 4 such that the load connector 22 is nested within it. The radiation shield 30 is arranged to abut a corresponding radiation shield extending towards the first vacuum chamber 2.

The flange 34 of the first vacuum chamber 2 is connected to a sealing flange 38 by metallic bellows 40. The sealing flange 38 is sealed to a complementary sealing flange 41 in the second sealing mechanism 28, and a seal 42 provided in between the sealing flanges 38, 41.

The metallic bellows 32, 36, 40 are sinuous couplings that have a long thermal conduction path. The bellows 32, 36 therefore act as thermal insulators and allow coupled components to be maintained at substantially different temperatures. The sinuous bellows 32, 36 can also extend or contract due to changes in temperature or mechanical load, or small relative movements of the magnets. This flexibility is advantageous because the temperature of the magnets can vary from 4K in operation to around 300K in an idle state and because large and variable mechanical loads can be placed on the components.

The radiation shield 30 is arranged between components such as the flange 34 which are at around 290K and components such as the sealing plate 47 which are at 4K. The purpose of the radiation shield 30 is to intercept any thermal radiation emitted from components of the sealing mechanism at room temperature and thereby prevent any heating of the load connectors 22, 26. The radiation shield 30 is maintained at a temperature of around 70K so that it emits minimal thermal radiation itself. Thus, the radiation shield 30 should not cause any significant heating effect for the load connectors 22, 26 or any other component at a lower temperature.

The load connectors 22,26 comprise conical recesses 48A, 48B at their ends. A conical location piece 50 can be provided between the sealing plates 47, 49 of the load connectors 22, 26 when they are assembled together to ensure that they are correctly aligned. Correct alignment of the load connectors 22, 26 can ensure that the attractive force between the magnets is spread evenly and equally among the plurality of load connectors. Generally only one pair of load connectors includes these alignment features. The remaining load connectors are free to slide with respect to each other so that they are not over constrained. The vacuum chambers 2, 4 are also free to make small movements with respect to one another because of the rails 10, 12 described previously.

When the first and second sealing mechanisms 24, 28 are assembled together a spacing 33 is created between the outer components such as the flange 34 and the radiation shield 30, and a spacing 31 is created between the radiation shield 30 and the inner components such as the sealing plate 47. These two spacings 31, 33 are in fluid communication with one another such that they form a single vacuum chamber 46. The vacuum chamber 46 is initially filled with air at normal atmospheric pressure. However, a port 44 is provided in the second sealing mechanism 28 in order to evacuate the vacuum chamber 46. This vacuum chamber 46 prevents any conductive or convective heating of the load connector 22 where it extends between the two vacuum chambers 2, 4.

Figure 4:
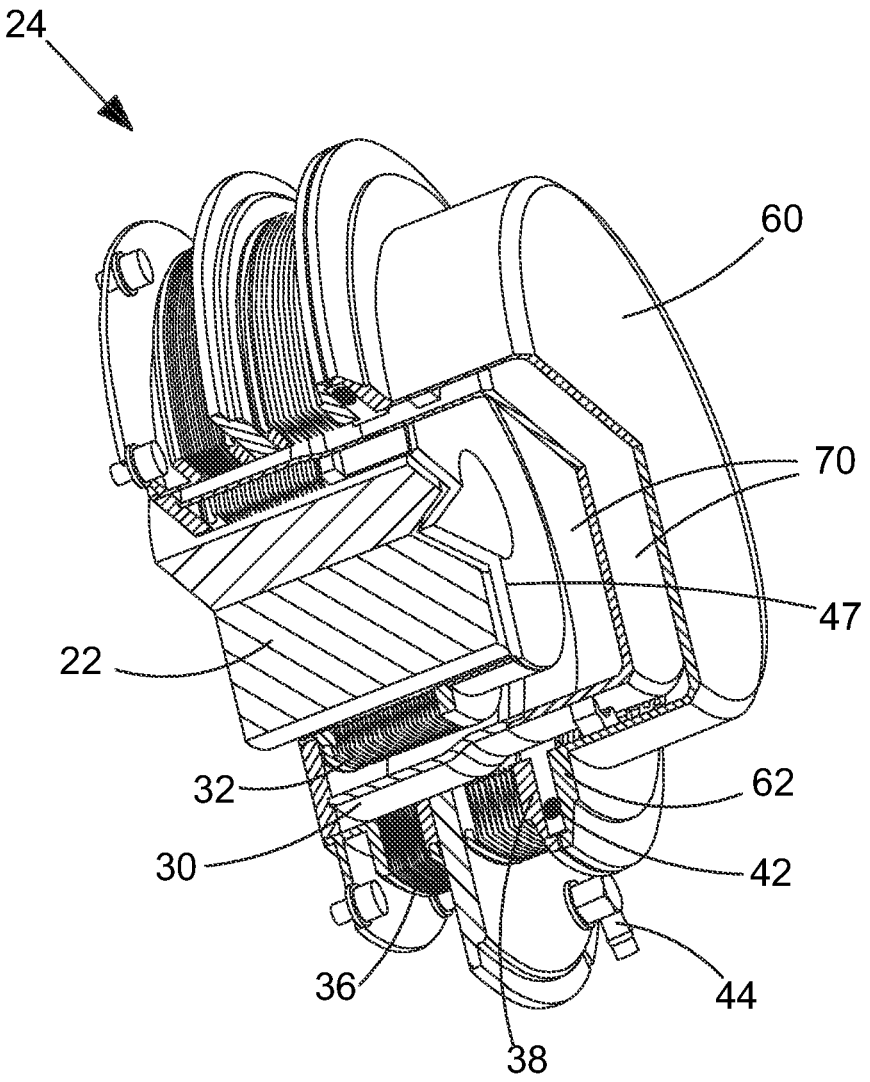
FIG. 4 is a view in partial cross-section of a capped sealing mechanism for use in an apparatus in an embodiment of the invention.
Figure 5:
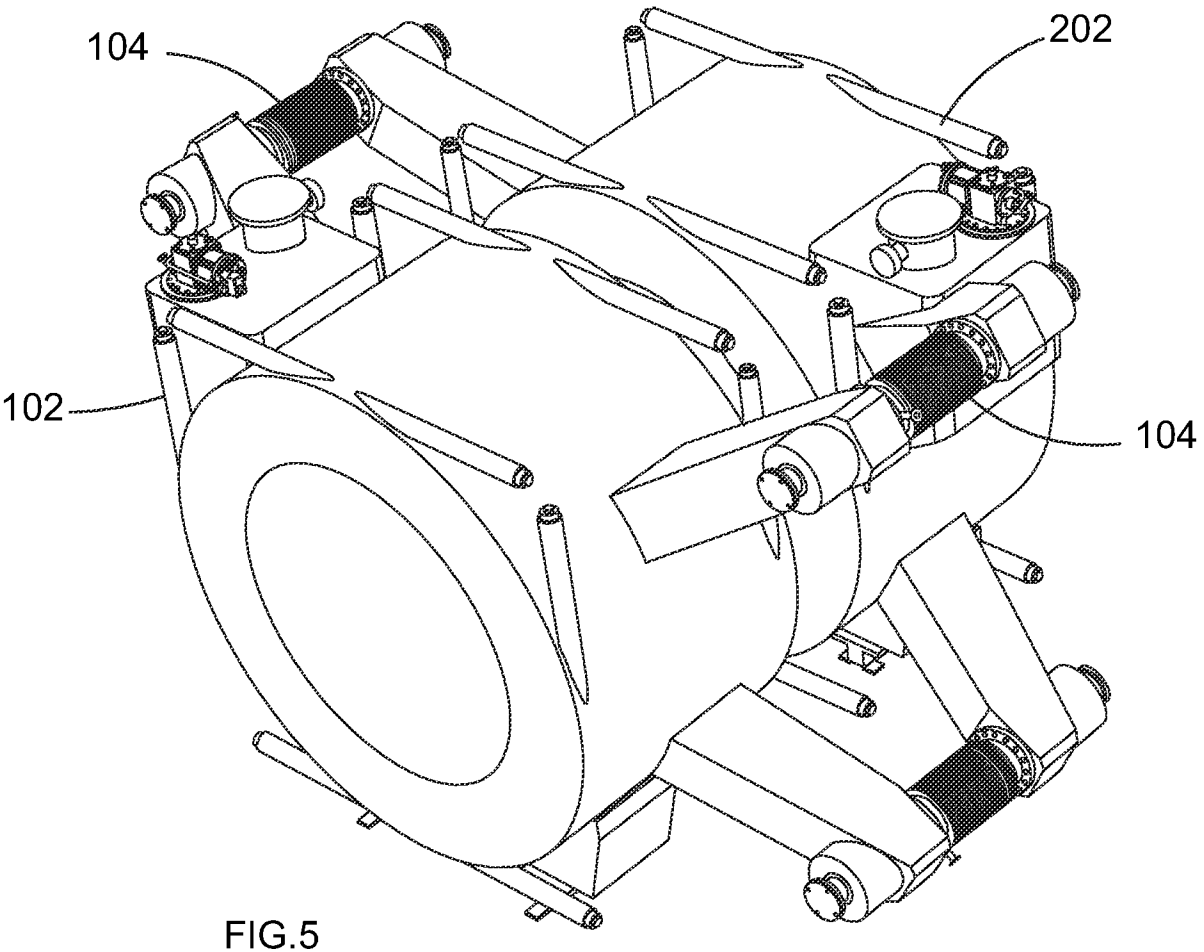
FIG. 5 is perspective view of an apparatus including two superconducting magnets in another embodiment of the present invention.
Figure 6:
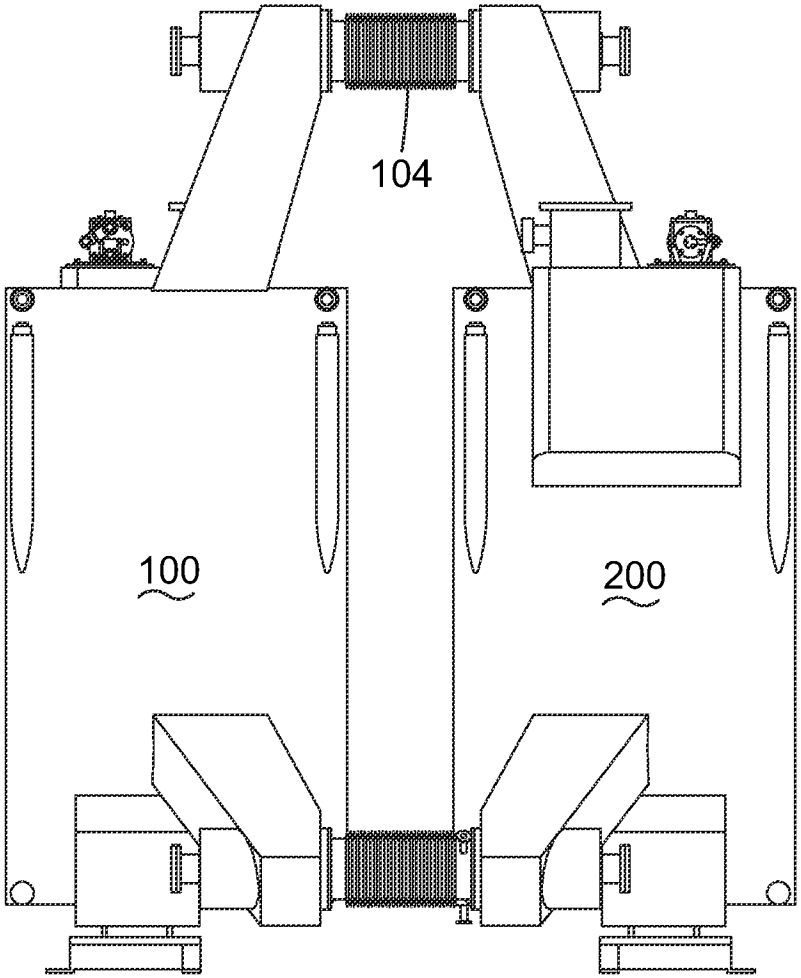
FIG. 6 is a side view of the apparatus shown in FIG. 5.
Figure 7:
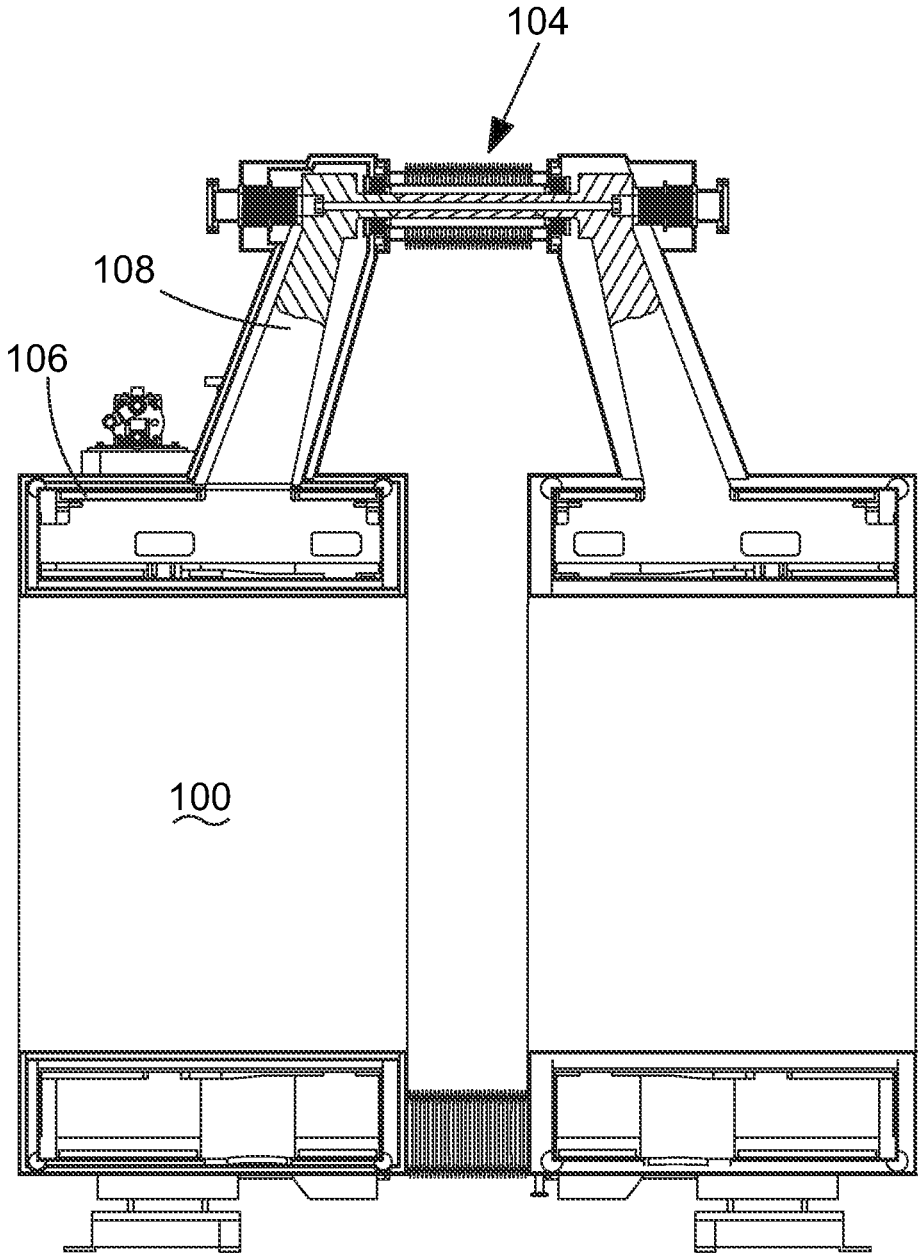
FIG. 7 is a cross-sectional view of the apparatus shown in FIG. 5.
Figure 8:
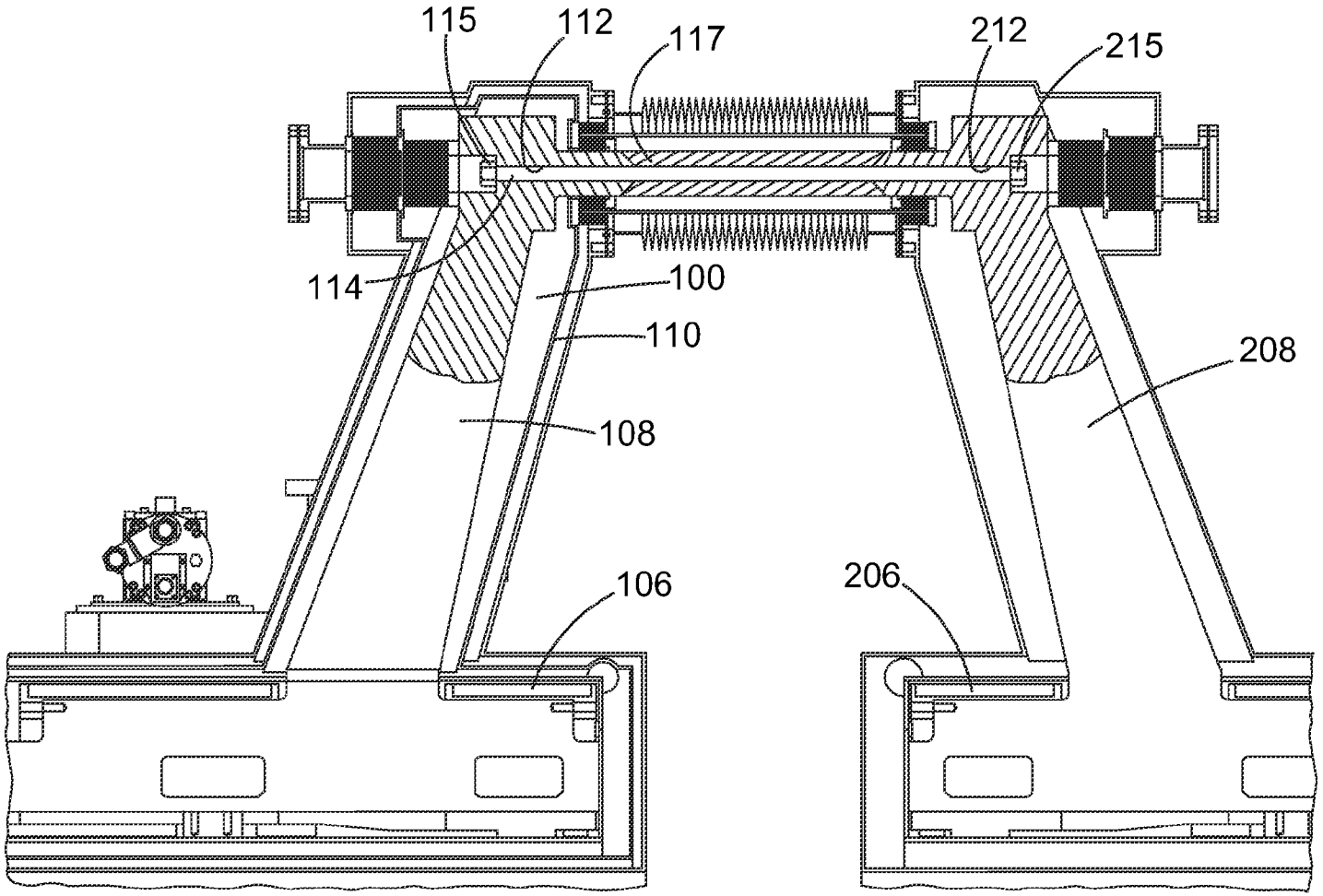
FIG. 8 is a cross-sectional view showing further detail than FIG. 7.
Figure 9:
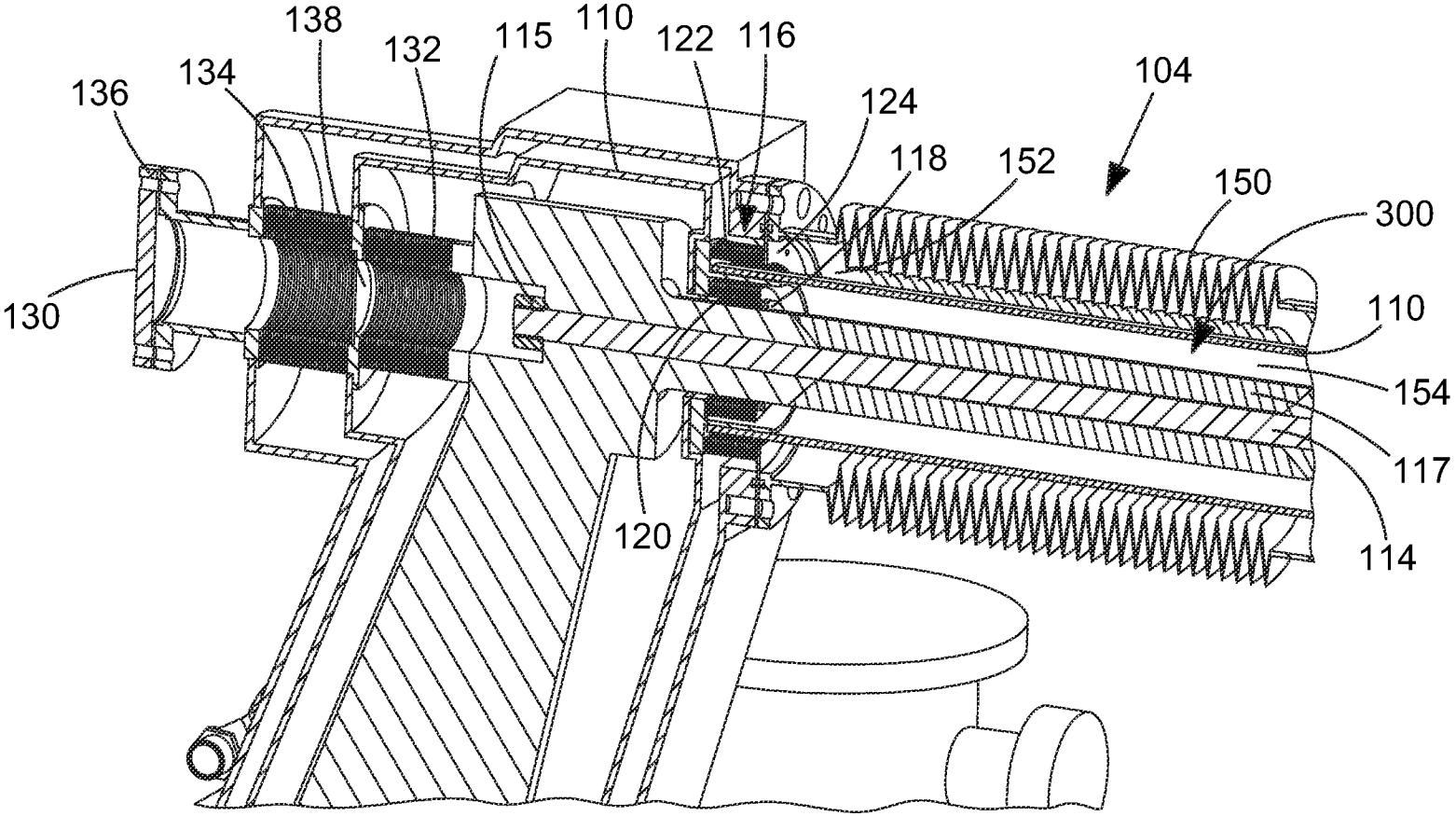
FIG. 9 is a cross-sectional view in perspective showing further detail than FIG. 8.
Figure 10:
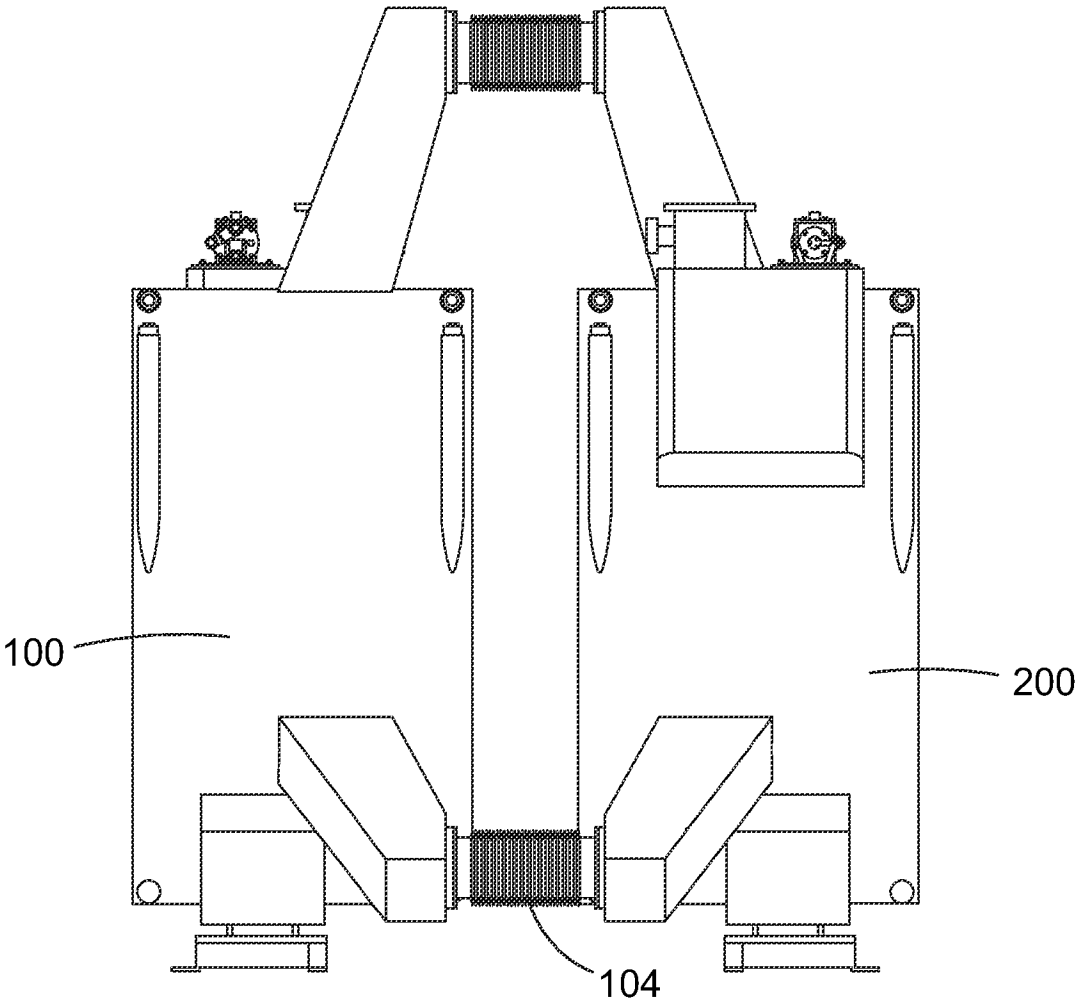
FIG. 10 is a side view of an apparatus including two superconducting magnets in another embodiment of the invention.

FIG. 4 shows a partial cross-section of a capped sealing mechanism. In this arrangement a cap 60 is fitted to the sealing mechanism 24 so that a single magnet can be used in isolation. The cap 60 includes a sealing flange 62 which is connected to the sealing flange 38 on the sealing mechanism 24, with a seal 42 provided in between.

The sealing plate 47 is separated slightly from the end face of the load connector 22 to minimise thermal contact between these components. The separation is maintained because the metallic bellows 32 are designed to operate as a spring, providing a biasing force on the sealing plate 47.

When the cap 60 is fitted to the sealing mechanism a chamber 70 is created between the cap 60 and the radiation shield 30, and including the spacing between the radiation shield 30 and the sealing plate 47. A port 44 is provided in the sealing mechanism 24 to allow the chamber 70 to be evacuated. This minimises thermal contact between the load connector 22 and the cap 60 so that the heating effect on the load connector 22 is minimised.

The capped sealing mechanism is intended to be used when only one magnet is used and there are no significant forces to be balanced. The cap 60 allows a load connector 22 to be covered so that it does not cause any heating of the magnet. This can be achieved because the cap 60 creates a vacuum chamber 70 around the load connector 22 so that there is minimal thermal contact between the load connectors 22 and the surrounding environment. Generally a separate cap 60 is required for each load connector 22.

FIGS. 5-10 show an alternative embodiment of the invention. In this embodiment two magnets (not shown) are arranged in respective vacuum chambers 100, 200, mounted in frames 102, 202, that are permanently connected together. The magnets are connected together using arms 104 that are supported radially outside the circumference of the magnets. In this way a free space can be created directly between the magnets for use in performing measurements and/or radiotherapy treatments. For example, this arrangement may allow a radiotherapy system to be placed between two Magnetic Resonance Imaging coils.

The first vacuum chamber 100 encloses a coil 106 that is part of the magnet. The coil 106 is connected to an arm 108 that is also enclosed by the vacuum chamber 100 and extends radially outwardly with respect to the main axis of the magnet. The arm 108 is, of course, in thermal contact with the coil so it is maintained at approximately 4K. The arm 108 is surrounded by a radiation shield 110 so that it is shielded from thermal radiation emitted by inner surfaces of the vacuum chamber 100 that are at room temperature.

A bore 112 is provided at the end of the arm 108, and a tie bar 114 extends through the bore 112 to be connected to a corresponding bore 212 at the end of a corresponding arm 208 in the second vacuum chamber 200. The arm 208 in the second vacuum chamber 200 is connected to a magnetic coil 206, and therefore the tie bar 114 connects the two magnets and holds the assembly together. The tie bar 114 also ensures correct alignment of the coils 106, 206. Nuts 115, 215 are provided at the ends of the tie bar 114 so that it is held securely in place between the arms 108, 208.

A sealing mechanism 116 is provided around the arm 108. The sealing mechanism 116 includes a sealing plate 118 that is connected to the arm 108 and defines a boundary of the vacuum chamber 100. The sealing plate 118 is connected to the radiation shield 110 via metallic bellows 120. In turn the radiation shield 110 is connected to a flange 124 via metallic bellows 122. This arrangement allows the arm 108 and the tie bar 114 to be maintained at around 4K, the radiation shield 110 to be maintained at around 70K and the outer surfaces of the vacuum chamber 100 such as the flange 124 to be maintained at room temperature.

The arm 108 is chamfered at its end, just beyond the sealing plate 118. The tie bar 114 emerges from the bore 112 at the chamfered end of the arm 108. A load carrying strut 117 abuts the chamfered end of the arm 108 and extends towards a corresponding chamfered end of the arm 208 in the second vacuum chamber 200. The load carrying strut 117 includes a bore that accommodates the tie bar 114. The load carrying strut 117 is arranged to resist any compressive load between the two coils 106, 206. A pre-stress can be applied on the load carrying strut 117 so that it can resist compressive forces without deflecting.

The flange 124 is connected to cylindrical metallic bellows 150 that enclose the tie bar 114 and the load carrying strut 117 where they extend between the vacuum chambers 100, 200. The load carrying strut 117 is also surrounded by the radiation shield 110 which intercepts any thermal radiation emitted by the cylindrical metallic bellows 150 so that the load carrying strut 117 is protected from thermal radiation.

A spacing 152 is created between the cylindrical bellows 150 and the radiation shield 110 and a further spacing 154 is created between the radiation shield 110 and the load carrying strut 117. These two spacings 152, 154 are in fluid communication and together define a chamber 300. The chamber 300 is separated from the vacuum chambers 100, 200, and it is evacuated in order to minimise any thermal contact between the load carrying strut 117 and the surrounding environment. In this way the load carrying strut 117 can resist compressive forces between the coils 106, 206 without being a source of heating that requires additional cooling requirements.

The nut 115 at the end of the tie bar 114 can be accessed via an access port 130. The access port 130 is normally closed. However, the access port 130 can be opened so that the nut 115 can be removed. The access port 130 includes cylindrical bellows 132, 134 extending between the arm 108 and the radiation shield 110 and between the radiation shield 110 and an inner surface of the vacuum chamber 100. A removable cap 136 is provided in the access port 130, and a removable radiation cap 138 is provided between the cylindrical bellows 132, 134. The tie bar 114 can therefore be accessed in the chamber 300, without affecting the integrity of the vacuum chamber 100, which can remain sealed.

Figure 11:
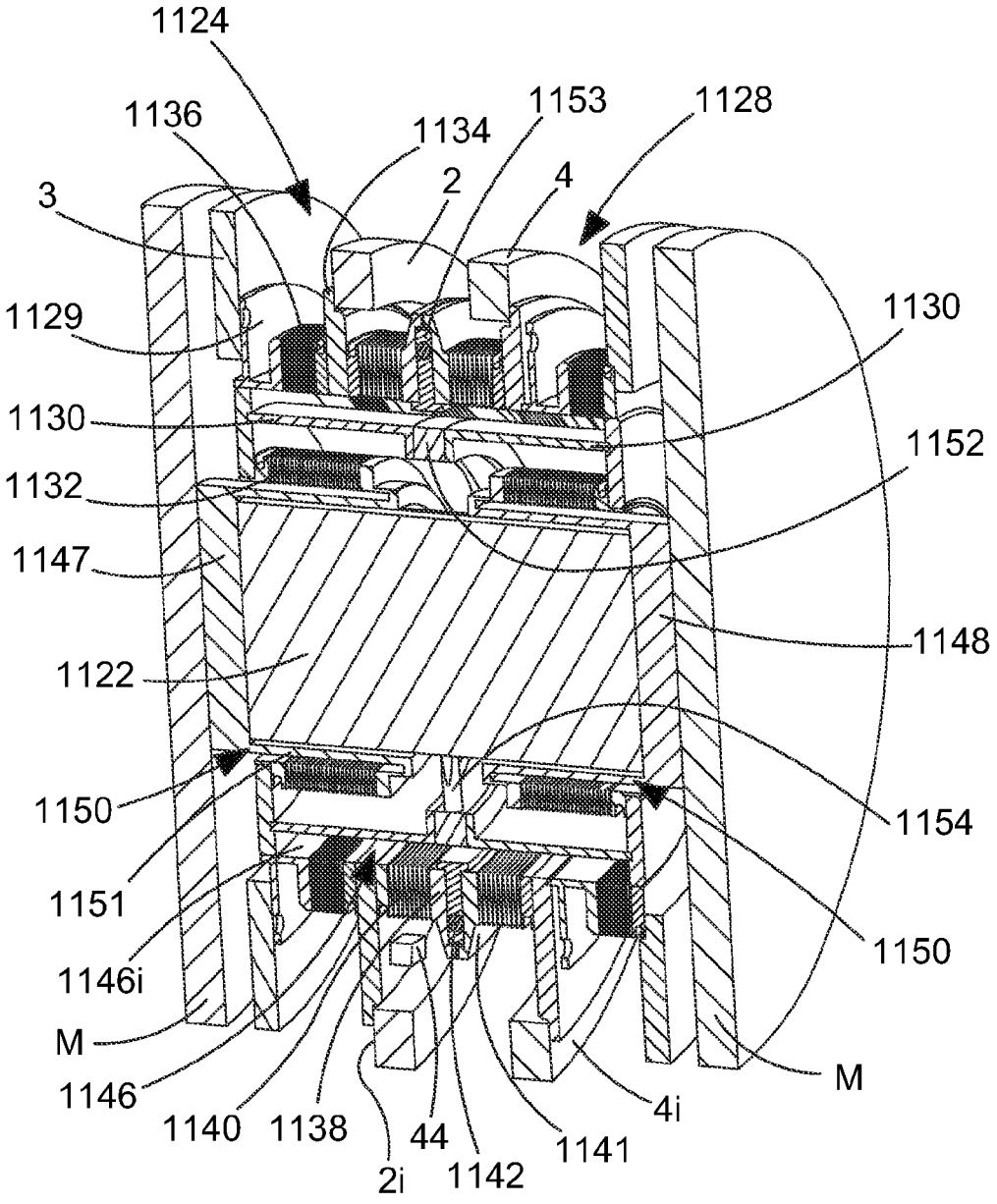
FIG. 11 is a cross-sectional view of an alternative sealing mechanism and load connector arrangement.

FIG. 11 shows an alternative form of sealing mechanisms 1124, 1128 which may be used in a similar way to and in place of the sealing mechanisms 24, 28 which are described above. This form of sealing mechanism is useful particularly in retrofit situations where load connectors 22 of the type described above are not provided on the magnets M at initial assembly. In the case of the arrangement shown in FIG. 11, most, if not all, of the load connector can form part of the sealing mechanism or at least be fitted with the sealing mechanism. It is noted that there is no requirement for the load connector to be attached to the magnet M where a compressive load is to be borne by the load connector.

In the arrangement of FIG. 11 the load connector comprises a load connector pin 1122 housed in the sealing arrangement and a pair of sealing plates 1147 and 1148 located at each end of the pin 1122. The pin 1122 may be fixedly mounted to one or both plates 1147, 1148 or merely arranged to contact therewith under load. Similarly one or both sealing plates 1147, 1148 may be fixedly mounted to the magnet/cold mass M provided in the respective vacuum chamber 2, 4 or merely arranged to contact therewith under load.

As in the arrangement shown in FIGS. 1 to 3, again one sealing mechanism 1124 is mounted on and for sealing the first vacuum chamber 2 and the other sealing mechanism 1128 is mounted on and for sealing the second vacuum chamber 4. A third vacuum chamber 1146 is formed between the sealing mechanisms 1124, 1128. The sealing mechanisms are symmetric so only the first sealing mechanism 1124 is described in detail below.

The load connector pin 1122 contacts with the sealing plate 1147 which extends across an end face of the load connector pin 1122. The sealing plate 1147 defines a boundary of the first vacuum chamber 2 and (at least in use—with the magnets energised) it is in thermal equilibrium with the load connector pin 1122 and the first magnet, at approximately 4K. The sealing plate 1147 also forms the end of a socket 1150 having an annular side wall 1151 which receives and locates an end of the load connector pin 1122. The other end of the pin 1122 is received in a corresponding socket 1150 in the other sealing mechanism 1128. The sealing plate 1147 is connected to a radiation shield 1130 by metallic bellows 1132, which are convoluted edge welded and act as a thermal insulator. The metallic bellows 1132 extend from an end of the annular side wall 1151 back towards the first vacuum chamber 2 so that the load connector pin 1122 is partially nested within the bellows 1132. The radiation shield 1130 is connected to a flange 1129 that rests against the radiation shield 3 in the first vacuum chamber 2. The flange 1129 could be riveted to the radiation shield 3 but sliding contact allows for more relative movement as parts move due to temperature changes and so on. Thus it should be noted that in alternatives, the sealing mechanisms shown in FIG. 3 may also be implemented with sliding contact between these parts rather than riveting. The flange 1129 is connected to a further flange 1134 by metallic bellows 1136. This further flange 1134 is welded to an outer part of the first vacuum chamber 2 and is at a temperature of around 290K.

The radiation shield 1130 extends from the flange 1129 towards the second vacuum chamber 4 such that the load connector pin 1122 is nested within it. The radiation shield 1130 is arranged to extend towards a corresponding radiation shield 1130 in the other sealing mechanism 1128 and extending towards the first vacuum chamber 2.

The further flange 1134 connected to the first vacuum chamber 2 is connected to a sealing flange 1138 by metallic bellows 1140. The sealing flange 1138 is sealed to a complementary sealing flange 1141 in the second sealing mechanism 1128, and a seal 1142 is provided in between the sealing flanges 1138, 1141.

A support ring 1152 is provided where the radiation shields 1130 of the sealing mechanisms 1124, 1128 meet. This is supported via springs (not shown) from an interface ring 1153 provided between the sealing flanges 1138, 1141 and via spring supports 1154 contacting with the load connector pin 1122. This helps control the position of the radiation shields 1130 relative to the load connector pin 1122 and the outer layer of the sealing arrangement. The load connector pin 1122 can be considered to be floating relative to the sealing mechanisms 1124, 1128. Further the load connector pin 1122 or indeed the whole load connector can be considered to be floating relative to the magnets/vacuum chambers due to the mounting of the pin 1122 in the sealing arrangement and the flexibility given by the metallic bellows 1132, 1136, 1140 (insulating couplings).

Again when there is no second magnet with its accompanying vacuum chamber 4, a cap (not shown) may be placed over the sealing mechanism 1124 of the first vacuum chamber 2 similar to what is shown in FIG. 4 to ensure good thermal insulation of the first vacuum chamber 2. The load connector pin 1122 may be retained or removed when the sealing mechanism is capped.

The remainder of the nature, functioning and operation of the alternative sealing mechanisms 1124, 1128 shown in FIG. 11 is the same as for the sealing mechanisms 24, 28 described in relation to FIG. 3.

Note that a port 44 provided in the sealing arrangements of all the embodiments as particularly described above with respect to the embodiment of FIG. 3 can be used to introduce gas such as helium for a helium purge to reduce or avoid icing, as well as used for evacuating air to/from the vacuum chamber formed by the sealing mechanisms.

The invention claimed is:

1. A magnet apparatus comprising:

a first vacuum chamber;

a second vacuum chamber;

a first magnet disposed within the first vacuum chamber such that the first magnet is thermally isolatable from the exterior of the first vacuum chamber;

a load connector extending from the first vacuum chamber into the second vacuum chamber so that a load on the first magnet is transferable to the second vacuum chamber, wherein the load connector is in thermal contact with the first magnet and is thermally isolatable from the exterior of the first vacuum chamber and the exterior of the second vacuum chamber, further comprising a cap for the load connector, wherein the first vacuum chamber comprises a sealing arrangement through which the load connector extends, and wherein the second vacuum chamber is provided between the cap and the sealing arrangement.

2. The apparatus of claim 1 further comprising a radiation shield provided between the load connector and the cap.

3. The apparatus of claim 2 further comprising a further radiation shield between the first magnet and an inner wall of the first vacuum chamber.

4. The apparatus of claim 3 wherein the radiation shield provided between the load connector and the cap is thermally coupled to the radiation shield in the first vacuum chamber.

5. The apparatus of claim 3 wherein a first thermally insulating coupling is provided between the load connector and said further radiation shield, and a second thermally insulating coupling is provided between said further radiation shield and an inner wall of the first vacuum chamber.

6. A magnet apparatus comprising:

a first vacuum chamber;

a second vacuum chamber;

a first magnet disposed within the first vacuum chamber such that the first magnet is thermally isolatable from the exterior of the first vacuum chamber;

the first vacuum chamber comprising a sealing arrangement arranged to accept a load connector for extending from the first vacuum chamber into the second vacuum chamber so that a load on the first magnet is transferable to the second vacuum chamber whilst the load connector is thermally contactable with the first magnet and is thermally isolatable from the exterior of the first vacuum chamber and the exterior of the second vacuum chamber, further comprising a cap for the sealing arrangement, and wherein the second vacuum chamber is provided between the cap and the sealing arrangement.

7. The apparatus of claim 6 further comprising a radiation shield provided between the sealing arrangement and the cap.

8. The apparatus of claim 7 further comprising a further radiation shield between the first magnet and an inner wall of the first vacuum chamber.

9. The apparatus of claim 8 wherein the radiation shield provided between the sealing arrangement and the cap is thermally coupled to the radiation shield in the first vacuum chamber.

10. The apparatus of claim 8 wherein a first thermally insulating coupling is provided between the load connector and said further radiation shield, and a second thermally insulating coupling is provided between said further radiation shield and an inner wall of the first vacuum chamber.

11. The apparatus of claim 6 in which the load connector comprises a removable load corrector pin and the sealing arrangement comprises a socket in which the load connector pin is receivable.

12. The apparatus of claim 11 in which the cap is arranged to seal to the sealing arrangement whilst the load connector pin is disposed in the socket.

13. The apparatus of claim 11 in which the load connector pin is absent from the apparatus when the cap is sealed to the sealing arrangement.

* * * * *